US006958088B1

(12) United States Patent
Moriyama

(10) Patent No.: US 6,958,088 B1
(45) Date of Patent: Oct. 25, 2005

(54) CARBON SEPARATION AND COLLECTION DEVICE USED FOR HIGH PERFORMANCE DUST COLLECTOR

(76) Inventor: Toshio Moriyama, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/950,292

(22) Filed: Sep. 27, 2004

(51) Int. Cl.[7] ..... B03C 3/74

(52) U.S. Cl. ..... 96/39; 96/42; 96/44; 96/47; 96/51; 96/94; 96/98; 210/243; 210/748; 422/186.04

(58) Field of Search ..... 96/28, 39–51, 96/94, 97, 98; 95/74–79; 210/243, 748; 422/186.04

(56) References Cited

U.S. PATENT DOCUMENTS

| | | | | | |
|---|---|---|---|---|---|
| 1,575,165 | A | * | 3/1926 | Hopkinson | 95/76 |
| 1,719,354 | A | * | 7/1929 | Alsop | 426/97 |
| 2,100,155 | A | * | 11/1937 | Beran | 96/39 |
| 2,212,885 | A | * | 8/1940 | Pound et al. | 96/30 |
| 2,298,510 | A | * | 10/1942 | Pound et al. | 96/42 |
| 2,331,028 | A | * | 10/1943 | Hegan et al. | 96/42 |
| 2,352,061 | A | * | 6/1944 | Yost et al. | 96/42 |
| 2,383,111 | A | * | 8/1945 | Dahlman | 96/42 |
| 2,383,112 | A | * | 8/1945 | Dahlman | 96/40 |
| 2,486,877 | A | * | 11/1949 | Ransburg et al. | 96/42 |
| 2,663,380 | A | * | 12/1953 | Savitz | 96/41 |
| 3,375,638 | A | * | 4/1968 | Dungler | 96/39 |
| 3,701,236 | A | * | 10/1972 | Rotsky et al. | 96/40 |
| 3,958,961 | A | * | 5/1976 | Bakke | 96/47 |
| 4,185,971 | A | * | 1/1980 | Isahaya | 96/40 |
| 4,321,066 | A | * | 3/1982 | Masuda | 96/40 |
| 5,084,077 | A | * | 1/1992 | Junker et al. | 96/39 |
| 5,110,324 | A | * | 5/1992 | Testone et al. | 95/73 |
| 6,558,456 | B2 | * | 5/2003 | Nissinen | 96/39 |
| 6,648,948 | B1 | * | 11/2003 | Moriyama | 96/42 |

FOREIGN PATENT DOCUMENTS

| | | | | |
|---|---|---|---|---|
| JP | 53-116576 | * | 10/1978 | 96/39 |

* cited by examiner

*Primary Examiner*—Richard L. Chiesa

(57) ABSTRACT

A carbon separation and collection device used for a high performance dust collector includes a water supply tube, a water pump, a high pressure negative electrode discharge device, a high pressure positive electrode discharge device, a rotary brush, a removing plate, a carbon collector, a liquid tank, and a speed change device and an exhausting tube. The two discharge devices serve to achieve a function of electrolyte. When the cleaning liquid with carbon flows into the water supply tube by using the water pump. The carbon is adhered to the high pressure positive electrode discharge device. The high pressure positive electrode discharge device is driven to rotate by the speed change device. The carbon is moved from the high pressure positive electrode discharge device by the rotary brush and removing plate. Then, the removing carbon drops into the carbon collector.

2 Claims, 1 Drawing Sheet

CARBON SEPARATION AND COLLECTION DEVICE USED FOR HIGH PERFORMANCE DUST COLLECTOR

FIELD OF THE INVENTION

The present invention relates to carbon separation and collection devices, and in particular to a carbon separation and collection device used for a high performance dust collector which has the effect of carbon separation and collection so as to improve the technological disadvantage in the high performance dust collector.

BACKGROUND OF THE INVENTION

Exhaust gas from the burnt light or heavy diesel oil produces coal particles. If this gas is vented to the air directly, the air will be polluted and people's health will be threatened by diseases from air pollution.

In some prior art design, the coal particles are removed by polarization and then polarized coal particles are beaten so as to achieve the object of dust accumulation. However, this prior art can not achieve a preferred effect. The polarized coal particles can still mix in the air so that the effect is reduced greatly.

A development is disclosed by the inventor of the present invention, which is U.S. Pat. No. 6,648,948, "High Performance Dust Collector". The high performance dust collector has a main body. The main body comprises a suction tube, a discharging electrode, a discharging plate, a dust accumulating electrode, and an exhaust tube. When exhaust gas from the burnt light or heavy diesel oil enters into the suction tube, since the exhaust gas passes through the discharging electrode and the discharging plate with negative charges, the coal particles in the exhaust gas become anions. When the waste gas passes through the metal net transfer belt, the coal particles with anions will adhere to the metal net transfer belt since the dust accumulating electrode is connected to a positive voltage end. Thereby, air exhausted from the exhaust tube has been cleaned and thus has no coal particles.

However, in this prior art, the metal net transfer belt has a structure like a circle belt which can be used cyclically. Another cleaning liquid tank is installed for cleaning the metal net transfer belt. However, the cleaning liquid has carbons. This is disadvantageous for the whole system.

SUMMARY OF THE INVENTION

Accordingly, the primary object of the present invention is to provide a carbon separation and collection device used in a high performance dust collector which has the effect of carbon separation and collection so as to improve the technological disadvantage in the high performance dust collector.

To achieve above objects, the present invention provides a carbon separation and collection device used for a high performance dust collector. The device comprises a water supply tube, a water pump, a high pressure negative electrode discharge device, a high pressure positive electrode discharge device, a rotary brush, a removing plate, a carbon collector, a liquid tank, and a speed change device and an exhausting tube. The two discharge devices serve to achieve a function of electrolyte when the cleaning liquid with carbon flows into the water supply tube by using the water pump. The carbon is adhered to the high pressure positive electrode discharge device. The high pressure positive electrode discharge device is driven to rotate by the speed change device. The carbon is moved from the high pressure positive electrode discharge device by the rotary brush and removing plate. Then, the removing carbon drops into the carbon collector.

The various objects and advantages of the present invention will be more readily understood from the following detailed description when read in conjunction with the appended drawing.

DETAILED DESCRIPTION OF THE INVENTION

Figure 1:
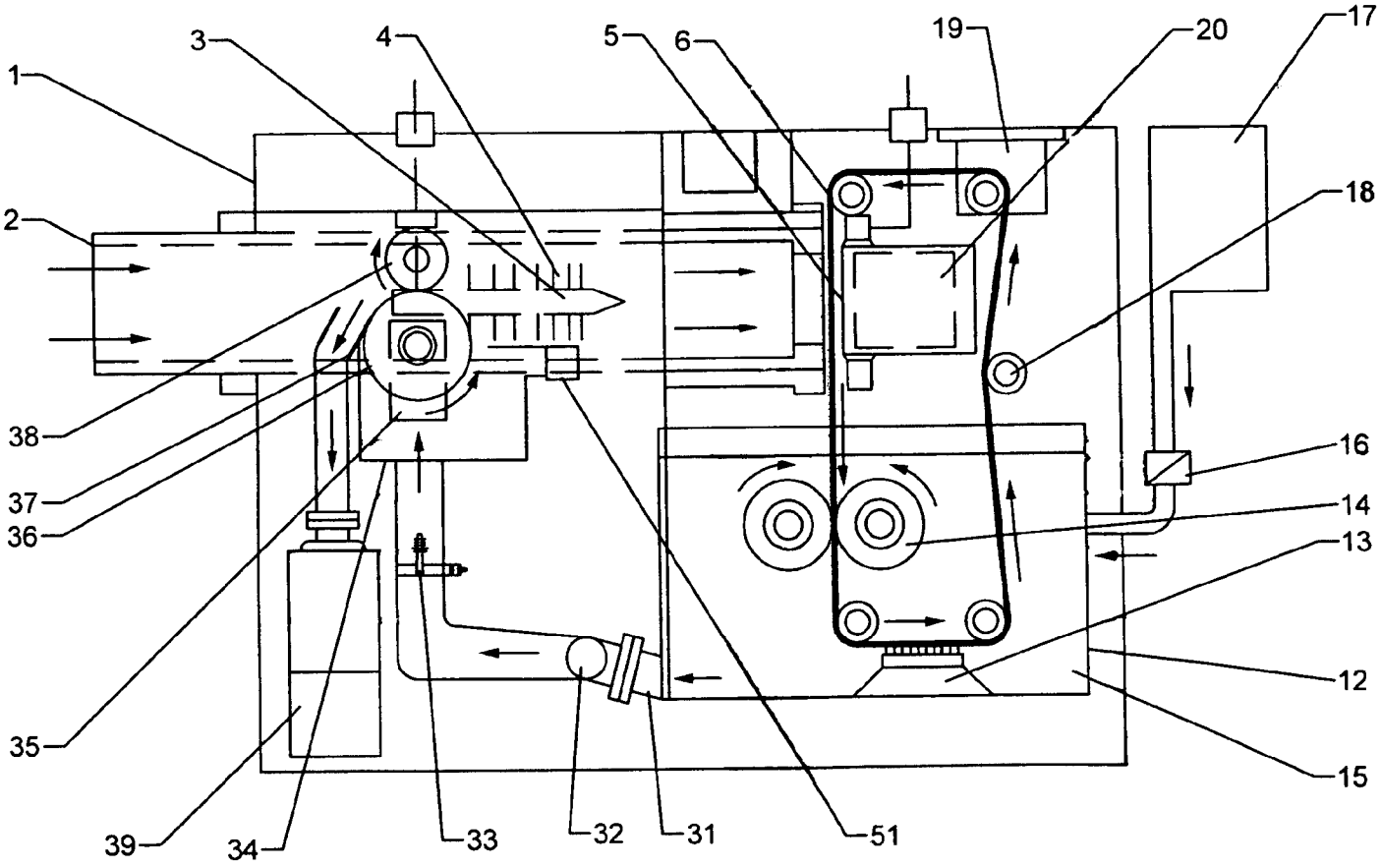
FIG. 1 is a structural schematic view of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIG. 1, the present invention is illustrated. The main body 1 of the high performance dust collector according to the present invention includes a suction tube 2, a discharging electrode 3, a discharging plate 4, a dust accumulating electrode 5, an exhaust tube 20, etc.

The suction tube 2 serves for guiding the exhausting gas with coal dust from the burnt light or heavy oil.

The discharging electrode 3 and discharging plate 4 are installed within the suction tube 2. The discharging electrode 3 and the discharging plate 4 are connected to a negative electrode.

The dust accumulating electrode 5 is connected to a positive voltage.

The metal net transfer belt 6 is installed to a distal end of the suction tube 2. All the gas passing through the distal end of the suction tube 2 will pass through the metal net transfer belt 6. The metal net transfer belt 6 is formed with a plurality of small holes. The metal net transfer belt 6 is formed between the suction tube 2 and the dust accumulating electrode 5.

The exhaust tube 20 is installed at a rear side of the dust accumulating electrode 5.

When exhaust gas from the burnt light or heavy diesel oil enters into the suction tube 2, since the exhaust gas passes through the discharging electrode 3 and the discharging plate 4 having negative charges, the coal particles in the exhaust gas become anions. When the waste gas passes through the metal net transfer belt 6, since the dust accumulating electrode 5 is connected to a positive voltage, the coal particles with anions will adhere to the metal net transfer belt 6. Thereby, air exhausted from the exhaust tube 20 has been cleaned and thus has no coal particles.

Since the metal net transfer belt 6 is like a circle and thus it can be used repeatedly. In the present invention, a clean device is installed for cleaning metal net transfer belt 6 with coal particles. The cleaning device includes a cleaning liquid tank 12, a fixing cleaner 13, and a rotary cleaner 14. Cleaning liquid 15 is filled into the cleaning liquid tank 12. By the rotation of the metal net transfer belt 6, the metal net transfer belt 6 will pass through the rotary cleaner 14 and the fixing cleaner 13 firstly for cleaning. Thereby, the coal particles in the exhaust air can be removed.

The features of the present invention will be described here.

A carbon separation and collection device is installed beside the cleaning liquid tank 12 for separating carbon in the cleaning liquid 15 by the electrolyte of positive and negative electrodes. A carbon collector 39 serves to collect the separated carbon. The carbon collector 39 is installed therewith.

The carbon separation and collection device includes a water supply tube 31, a water pump 32, a high pressure negative electrode discharge device 33, a high pressure positive electrode discharge device 36, a rotary brush 38, a removing plate 37, a carbon collector 39, a liquid tank 34, and a speed change device 35 and an exhausting tube 51.

The water supply tube 31 supplies the cleaning liquid 15 with carbon for further processing.

The water pump 32 serves for pumping the cleaning liquid 15 from the water supply tube 31.

The high pressure negative electrode discharge device 33 serves to discharge high pressure negative (cathode) current which has a radiation shape.

The high pressure positive electrode discharge device 36 serves to discharge high pressure positive (anodic) current which present a radiation shape. The high pressure positive electrode discharge device 36 is arranged as a cylinder annular sheet.

The speed change device 35 serves to drive the high pressure positive electrode discharge device 36 to rotate and changes the rotation speed of the high pressure positive electrode discharge device 36.

The rotary brush 38 has at least one brush at a surface thereof. The rotary brush 38 is installed at and adjacent to a top of the high pressure positive electrode discharge device 36.

The removing plate 37 is installed at a top of the carbon collector 39 aside the high pressure positive electrode discharge device 36 for removing the carbon from the high pressure positive electrode discharge device 36.

The carbon collector 39 is installed at a rear lower side of the removing plate 37 for further collecting the carbon.

The liquid tank 34 serves to store water installed at a top of the water supply tube and the high pressure positive electrode discharge device for receiving the high pressure positive electrode discharge device.

The exhausting tube 51 serves for exhausting undesired objects in the carbon separation and collection process.

By above mentioned structure, the high pressure negative electrode discharge device 33 and high pressure positive electrode discharge device 36 serve to achieve a function of electrolyte when the cleaning liquid 15 with carbon flows into the water supply tube 31 by using the water pump 32. The cleaning liquid 15 firstly flows through the high pressure negative electrode discharge device 33 and then is electrolyzed by using the discharging effect of negative electrode. Then the cleaning liquid 15 flows into the liquid tank 34. By the high pressure positive electrode discharge device 36, carbon can be completely separated from the cleaning liquid 15. The carbon is adhered to the high pressure positive electrode discharge device 36. The high pressure positive electrode discharge device 36 is driven to rotate by the speed change device 35. The carbon is removed from the high pressure positive electrode discharge device 36 by the rotary brush 38 and removing plate 37. Then, the removing carbon drops into the carbon collector 39.

From above mentioned description, it is known that the carbon separation and collection device used in a high performance dust collector of the present invention has the effect of carbon separation and collection so as to improve the technological disadvantage in the high performance dust collector.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A carbon separation and collection device for a high performance dust collector comprising:

a water supply tube for supplying a cleaning liquid with carbon for further processing;

a water pump for pumping the cleaning liquid from the water supply tube;

a high pressure negative electrode discharge device for discharging high pressure negative electric current which is arranged as a radiation shape;

a high pressure positive electrode discharge device for discharging high pressure positive electric current which is arranged with a radiation shape; the high pressure positive electrode discharge device being arranged as a cylinder annular sheet;

a speed change device for driving the high pressure positive electrode discharge device to rotate;

a rotary brush having at least one brush at a surface thereof; the rotary brush being installed at and adjacent to a top of the high pressure positive electrode discharge device;

a removing plate installed at a top of the carbon collector aside the high pressure positive electrode discharge device for removing the carbon from the high pressure positive electrode discharge device;

a carbon collector being installed at a rear lower side of the removing plate for further collecting the carbon; and a liquid tank installed at a top of the water supply tube and the high pressure positive electrode discharge device for receiving the high pressure positive electrode discharge device.

2. The carbon separation and collection device for a high performance dust collector as claimed in claim 1, wherein the speed change device changes the rotation speed of the high pressure positive electrode discharge device.

* * * * *